US011359514B2

(12) United States Patent
Cimen et al.

(10) Patent No.: US 11,359,514 B2
(45) Date of Patent: Jun. 14, 2022

(54) METHOD FOR MOUNTING AND/OR REMOVING COMPONENTS OF A TURBINE HAVING A TURBINE CASING, ADAPTER AND SYSTEM FOR USE IN THE METHOD AS WELL AS USE OF AN ADAPTER

(71) Applicant: SIEMENS AKTIENGESELLSCHAFT, Munich (DE)

(72) Inventors: Sezgin Cimen, Berlin (DE); Benjamin Runge, Berlin (DE); Thomas Meyer, Gigon (ES)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 208 days.

(21) Appl. No.: 16/476,606

(22) PCT Filed: Jan. 8, 2018

(86) PCT No.: PCT/EP2018/050323
§ 371 (c)(1),
(2) Date: Jul. 9, 2019

(87) PCT Pub. No.: WO2018/130479
PCT Pub. Date: Jul. 19, 2018

(65) Prior Publication Data

US 2019/0360361 A1 Nov. 28, 2019

(30) Foreign Application Priority Data

Jan. 11, 2017 (DE) ..... 10 2017 200 367.7

(51) Int. Cl.
*F01D 25/28* (2006.01)

(52) U.S. Cl.
CPC ..... *F01D 25/285* (2013.01); *F05D 2230/68* (2013.01)

(58) Field of Classification Search
CPC ..... F01D 25/285; F05D 2230/60; F05D 2230/68; F05D 2230/70; F05D 2260/31
See application file for complete search history.

(56) References Cited

U.S. PATENT DOCUMENTS 6,141,862 A 11/2000 Matsui et al.
2009/0265908 A1 10/2009 Corn et al.
(Continued)

FOREIGN PATENT DOCUMENTS

CN 2274185 Y 2/1998
CN 204454285 U 7/2015
(Continued)

OTHER PUBLICATIONS

PCT International Search Report corresponding to PCT International Application No. PCT/EP2018/050323 dated Jun. 25, 2018.
(Continued)

*Primary Examiner* — Moshe Wilensky
(74) *Attorney, Agent, or Firm* — Schmeiser, Olsen & Watts LLP

(57) ABSTRACT

A method for mounting and/or dismantling turbine components is provided. According to this method, a crane is fastened to a turbine casing half in the area of the joint, and at least one component such as for example a turbine blade is brought into its mounted position and/or is removed from its mounted position by means of the crane. For this purpose, the crane has a tower with a multiple section jib having a plurality of segments, thereby allowing the components to be positioned accurately for mounting/dismantling. The mobile crane is connected to the turbine casing half by means of an adapter. The adapter has a fastening pin which
(Continued)

is held in place by means of an existing through-bore in the turbine casing half. For the purpose of mounting the mobile crane, the adapter has a baseplate. For rotational locking of the crane, a securing element is provided.

6 Claims, 5 Drawing Sheets

(56) References Cited

U.S. PATENT DOCUMENTS

| | | | | |
|---|---|---|---|---|
| 2012/0317772 | A1 | 12/2012 | Herbold et al. | |
| 2013/0011241 | A1 | 1/2013 | Skaustein et al. | |
| 2015/0354597 | A1* | 12/2015 | I | F04D 19/00 415/209.3 |
| 2017/0276025 | A1 | 9/2017 | Kowalzik et al. | |
| 2017/0313556 | A1 | 11/2017 | Griese et al. | |
| 2019/0360361 | A1 | 11/2019 | Cimen et al. | |

FOREIGN PATENT DOCUMENTS

| | | | |
|---|---|---|---|
| CN | 104929237 | A | 9/2015 |
| DE | 102009003833 | A1 | 10/2009 |
| EP | 2535530 | A2 | 12/2012 |
| EP | 2543868 | A2 | 1/2013 |
| EP | 2990615 | A1 | 3/2016 |
| EP | 3023606 | A1 | 5/2016 |
| GB | 2306155 | B | 11/1997 |
| JP | 2004224520 | A | 8/2004 |
| KR | 930019767 | U | 9/1993 |
| WO | 2018130479 | A1 | 7/2018 |

OTHER PUBLICATIONS

Korean Office Action dated Jan. 11, 2021 for Application No. 10-2019-7023201.

PCT International Search Report corresponding to PCT International Application No. PCT/EP2018/050323.

* cited by examiner

METHOD FOR MOUNTING AND/OR REMOVING COMPONENTS OF A TURBINE HAVING A TURBINE CASING, ADAPTER AND SYSTEM FOR USE IN THE METHOD AS WELL AS USE OF AN ADAPTER

CROSS-REFERENCE TO RELATED APPLICATIONS

This application claims priority to PCT Application No. PCT/EP2018/050323, having a filing date of Jan. 8, 2018, which is based on German Application No. 10 2017 200 367.7, having a filing date of Jan. 11, 2017, the entire contents both of which are hereby incorporated by reference.

FIELD OF TECHNOLOGY

The following relates to a method for mounting and/or removing components of a turbine having a turbine casing. The following also relates to an adapter and a system for use in the method. Finally, the following relates to the use of an adapter.

BACKGROUND

The operations of mounting and/or removing turbine components, which can be for example the blades of the turbine, gives rise to the problem of the components in some cases having a not insignificant weight and having to be mounted and/or removed in a disadvantageous working position. In the case of some types of turbine, it is for example necessary for the blades to be removed in the 12 o'clock position of the rotor. The weight of the blades here in some cases is in the region of over 40 kg, for example between 46 and 48 kg.

Manual mounting and/or removal is problematic on account of the weight and the disadvantageous working position. It would be necessary, with the rotor in the 12 o'clock position, for a fitter to climb into the outlet casing, to remove the blades there manually and then pass them onto a colleague, in order for the latter to be able to transport the blades away.

Proceeding from the above, it is the object of embodiments of the present invention to provide for straightforward and safe mounting and/or removal of components of turbines.

SUMMARY

An aspect relates to a method for mounting and/or removing components of a turbine having a turbine casing, in the case of which

- a crane is fastened on the turbine casing, and
- at least one component which is to be mounted is moved into its installation position with the aid of the crane and/or at least one component which is to be removed is removed from its installation position with the aid of the crane, wherein the at least one component which is to be mounted and/or removed is in particular a turbine blade.

In other words, the basic concept of embodiments of the present invention consists in fastening a crane on a turbine casing directly or indirectly, in the latter case via an adapter, and, with assistance from the crane, in transporting turbine components to an installation position on the turbine, in order for the components to be mounted, and/or, in order for the turbine components to be removed, in transporting the components away from an installation position on the turbine.

The operation according to embodiments of the invention of fastening the crane on the turbine casing gives the advantage, on the one hand, that the crane can be arranged in particularly close proximity to the mounting and/or removal position. It is also possible to dispense with heavy counterweights at the foot of the crane, since the turbine itself constitutes the necessary counterweight, which is also sufficient for the transportation of comparatively heavy components.

The crane used according to embodiments of the invention is a mobile crane which, inter alia on account of its dimensions and its weight, requires little outlay in order to be transported, if required, to a necessary location of use on a turbine.

The crane is one such which has a tower and a jib, which is fastened on the tower in particular in an articulated manner, this having been proven to be particularly suitable. If this type of crane is used, it is the free end of the tower which is fastened on the turbine casing. The jib of the crane can then reach different installation positions of the turbine components in a flexible manner. The height of the tower is expediently selected such that the jib can pass over the rotor of the turbine.

It is in particular in the open state of a turbine casing which is divided in two by a joint running at least essentially horizontally that the crane is fastened on the lower casing half, in the region of the joint.

In a particularly advantageous configuration of the method according to embodiments of the invention, the crane is fastened on the turbine casing using at least one through-passage bore which is present in the turbine casing, in particular in the lower casing half, in the region of the joint. If use is made of one or more bores which are present any way in the casing, there is no need for the casing to be adapted in order for the method according to embodiments of the invention to be implemented, and the outlay required is therefore particularly low. For the purpose of fastening the crane, it is possible to use, in particular, those through-passage bores through which extend, in the closed state of the casing, the casing-closure joint bolts.

According to a further embodiment of the method according to embodiments of the invention, provision is made for the crane, or an adapter connected to the crane, to have a cylindrical fastening bolt, of which the outer contour is adapted to the inner contour of a through-passage bore which is present in the turbine casing, in particular in the lower casing half, in the region of the joint, and, for the purpose of fastening the crane, the fastening bolt is inserted into the through-passage bore and fixed by means of at least one screw. A fastening bolt has proven to be particularly suitable in order to fasten a crane straightforwardly in a temporally stable manner using a bore which is present in the casing, in particular in the region of the joint of the lower casing half. The fastening bolt, and thus the crane, can be fixed in the axial direction on the casing by means of the at least one screw.

Provision can also be made for use to be made of a crane which has a tower and a jib, which is fastened on the tower in particular in an articulated manner. In particular a cylindrical fastening bolt is then provided at the free end of the tower, or on an adapter fastened at the free end of the tower. The fastening bolt is configured, and arranged on the tower, or on the adapter which is, or can be, connected to the tower, such that the longitudinal axis of the fastening bolt and the longitudinal axis of the tower run at least essentially parallel and/or coincide.

It is also the case that the crane is fastened on the housing such that its tower is oriented at least essentially vertically.

In addition to the crane, a working platform can be provided temporarily, and the platform can be accessed by at least one fitter in order for mounting and/or removal work to be carried out. Thus, a further embodiment of the method according to embodiments of the invention is distinguished in that a working platform is fastened on the casing, at a distance of less than one meter from the crane, and the platform can be accessed by a user in order to carry out the mounting and/or removal operation. In a manner analogous to the crane, the working platform is likewise mounted on the lower half of a two-part turbine casing, in particular in the region of the joint.

The embodiments also relate to an adapter for use in the method according to embodiments of the invention, which has a crane-side attachment surface, which is to be directed toward the crane when the adapter is mounted, and a casing-side attachment surface, which is to be directed toward the casing of the turbine when the adapter is mounted, and also means for fastening on the crane and means for fastening on the casing.

The adapter according to embodiments of the invention has, in particular, one side which is adapted for fastening on the turbine casing and one side which is adapted for fastening on the crane.

The adapter has the great advantage that an in particular mobile crane which is not configured specifically for being fastened according to embodiments of the invention on the turbine casing can be straightforwardly connected to the casing. For example, it is possible for a mobile crane which has a tower with a base panel screwed to its free end to provide stability, for which through-passage and/or threaded bores are provided in the tower, to have the base panel removed and for an adapter according to embodiments of the invention, which has through-passage and/or threaded bores which correspond to those in the crane tower, to be fastened at the free end of the tower.

A further great advantage of using an adapter resides in the fact that a crane can be used on differently configured turbine casings, wherein all that is required is for each type of casing to have an associated adapter which is designed for fastening on the respective casing.

In a preferred configuration, the adapter according to embodiments of the invention comprises a crane-side base plate, which defines the crane-side attachment surface, and a casing-side base plate, which defines the casing-side attachment surface, the base plates being connected to one another. The crane-side and casing-side base plates extend in particular at least essentially parallel to one another.

The means for fastening on the housing comprise a cylindrical fastening bolt, which projects from the casing-side base plate. In a preferred configuration, the fastening bolt is adapted to a through-passage bore which is present anyway in a turbine casing, in particular in the lower casing half, in the region of the joint, and therefore in the mounted state, when the crane is fastened on the casing via the fastening bolt, the latter is seated in the bore in a form-fitting manner. In particular, the external diameter of the fastening bolt of the adapter corresponds to the internal diameter of a through-passage bore in the casing and the length of the fastening bolt of the adapter corresponds at least to the axial extent of the bore. It is also the case that the fastening bolt is adapted to a through-passage bore through which extend, in the closed state of the turbine casing, the joint bolts, the shape of the fastening bolt therefore corresponding to that of the joint bolts.

The means which the adapter according to embodiments of the invention has for fastening on the crane comprise through-passage and/or threaded bores, which are provided in the crane-side base plate and correspond in particular to through-passage and/or threaded bores which are provided in the crane, in a tower of the crane.

It is also possible to provide, in order to prevent rotation of the adapter in the mounted state, an in particular cylindrical securing element, which projects from the casing-side base plate. The securing element has a smaller diameter, and/or a shorter length, than the cylindrical fastening bolt. The securing element can be designed, and arranged, in particular such that, in the mounted state of the adapter, it engages in an aperture, a further through-passage bore, which is present in the turbine casing, in particular in the lower casing half, in the region of the joint. The securing element is particularly designed such that, in the mounted state, it is seated in the aperture, in particular a further through-bore, in the housing in a form-fitting manner.

The shape and dimensioning of the fastening bolt and also the shape, dimensioning and position of the securing element on the base plate can be adapted to the configuration of the respective turbine casing, in particular to through-passage bores which are present in the turbine casing, in the region of the joint. Should the operation according to embodiments of the invention of fastening a crane on a turbine casing by means of an adapter take place on differently configured turbine casings, it is possible to provide in particular for each type of casing a specifically adapted adapter with an appropriate fastening bolt and, in particular, securing element.

A further advantageous configuration provides in the fastening bolt, in particular in the end side thereof, a threaded bore for accommodating a tensioning screw, wherein the longitudinal axis of the threaded bore and the longitudinal axis of the fastening bolt are oriented at least essentially parallel to one another. In the mounted state, the fastening bolt can be fixed in the axial direction by means of a screw screwed into the threaded bore. If the head of a screw which is used has a smaller diameter than the through-passage bore, it is also possible to make use of a washer in a manner known per se.

According to a further embodiment, the adapter according to embodiments of the invention is distinguished in that the crane-side and the casing-side base plates are connected via a tubular connecting element. It is then the case that the casing-side base plate is fastened on the one end side of the tubular connecting element and the crane-side base plate is fastened on the other end side. As an alternative, or in addition, to the tubular connecting element, it is also possible for the two base plates to be connected to one another via stabilizing crosspieces. The tubular connecting element can be designed, for example, in the form of a round or quadrilateral tube.

In a development of the adapter, it is also the case that at least one recess is provided in the casing-side base plate, the recess extending as far as the periphery of the base plate. It is possible for a turbine casing, in particular in the region of the joint of the lower half of an open turbine casing, to accommodate elements, for example heads of mounted screws or the ends of mounted threaded rods and/or nuts, which restrict the amount of space available for the operation according to embodiments of the invention of fastening the crane, but which, for stability reasons, cannot be removed.

Using an adapter having a base plate with recesses at a suitable location can counteract this problem and achieve reliable temporary fixing of the crane—even if the amount of space available is restricted. The position and size of the recesses can be adapted to the specific nature of the turbine casing on which the crane is to be fastened, in particular to the number, size and position of non-removable elements.

The embodiments further relate to a system for use in the method according to the invention, comprising an adapter for fastening the crane on a turbine casing. The adapter is one such according to embodiments of the present invention which has been described in detail above.

The crane of the system according to embodiments of the invention comprises, in particular, a tower and a jib, which is connected to the tower in an articulated manner, wherein the jib has a plurality of, in particular three, jib segments connected to one another in an articulated manner.

In an advantageous configuration, the system according to embodiments of the invention also comprises a holder for a turbine component, the holder being provided on the crane, in particular on a jib of the crane. The holder can be designed, for example, in the form of a gripper or the like, in order to be able to grip a turbine component which is to be mounted and/or removed. In a development, the holder, in particular the gripper, can be adapted to the turbine components which are to be mounted and/or removed. If for example turbine blades are to be installed and/or removed, use is made of a holder, for example a gripper, which has its shape and/or dimensioning adapted to the shape and/or dimensioning of the blades. The gripper is then designed such that it can clamp a turbine component via the leading and trailing edges. Since the point of attachment is located above the center of gravity, the holder used, in a particularly preferred configuration, is a C hook.

Finally, embodiments of the invention relate to the use of an adapter for fastening a crane, in particular the tower of a crane, on a turbine casing, on the joint of the lower casing half of an open turbine casing. The adapter is one such according to embodiments of the present invention which has been described in detail above.

BRIEF DESCRIPTION

Some of the embodiments will be described in detail, with references to the following Figures, wherein like designations denote like members, wherein.

DETAILED DESCRIPTION

Figure 1:
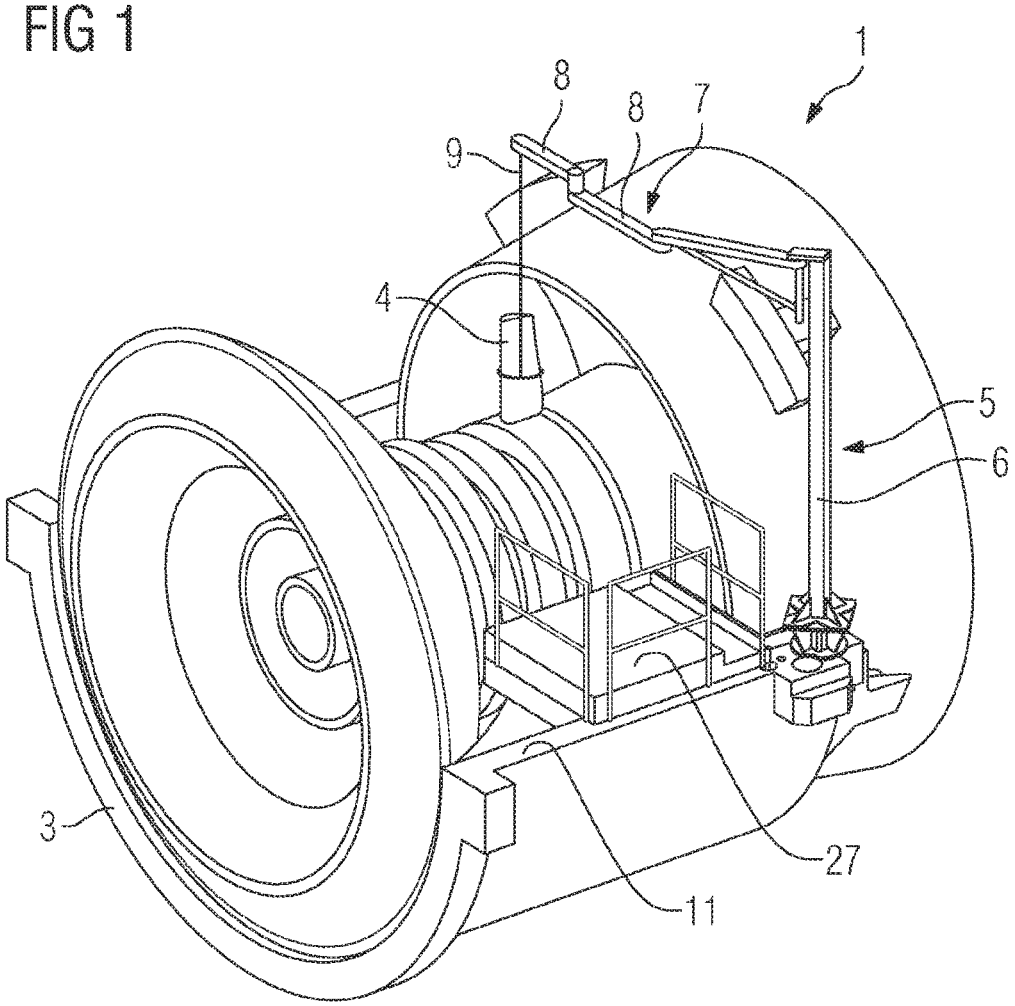
FIG. 1 is a schematic perspective view of a portion of a turbine which has a crane fastened on its casing, according to embodiments of the invention, by means of an adapter.

FIG. 1 shows a perspective view of a portion of a turbine 1. The turbine 1 comprises, in a manner known per se, a rotor 2 and a two-part turbine casing, of which only the lower casing half 3 can be seen in FIG. 1, since the upper casing half has been removed.

The blades 4 are to be removed from the rotor 2 of the turbine 1, and in the exemplary embodiment illustrated this takes place with implementation of one embodiment of the method according to embodiments of the invention.

For this purpose, in a first step, a mobile crane 5 has been fastened on the turbine casing. FIG. 1 shows the crane 5 already fastened on the casing.

The mobile crane 5 comprises a tower 6 and a jib 7, which is fastened on the tower in an articulated manner. In order to provide greater deflection-related flexibility, the jib 7 is subdivided into three segments 8, which in turn are connected to one another in an articulated manner. A cable 9 is fastened at the free end of the jib 7, the other end of the cable being connected to a holder for a turbine blade 4, the holder being defined in the present case by a gripper 10, which is indicated only schematically in the figures and which in this case is a C hook.

Within the context of the illustrated exemplary embodiment of the method according to embodiments of the invention, the crane 5, specifically the free end of the tower 6 of the crane 5, the free end being oriented downward in FIG. 1, has been fastened on the lower casing half 3, in the region of the horizontally running joint 11 of the turbine casing.

The tower 6 of the crane 5 here, rather than being connected directly to the lower casing half 3, is connected via an adapter 12 according to embodiments of the invention.

Figure 2:
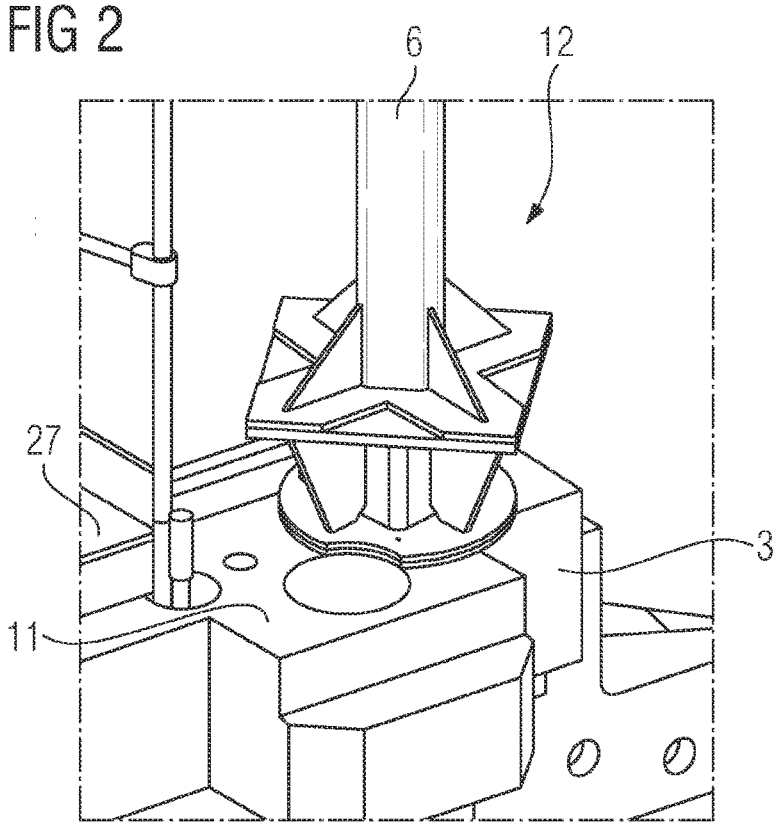
FIG. 2 is an enlarged illustration of the adapter illustrated in FIG. 1.
Figure 3:
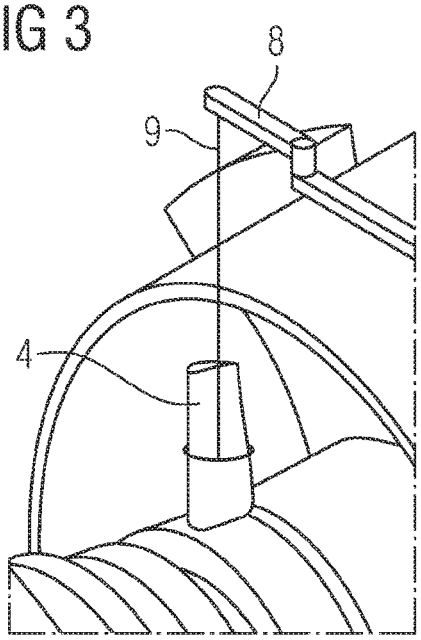
FIG. 3 is an enlarged illustration of a detail from FIG. 1.

An enlarged illustration of the adapter 12, which connects the tower 6 of the crane 5 to the lower casing half 3 of the turbine 1, can be gathered from FIG. 2. Further enlarged illustrations in different views, and also sectional illustrations, of the adapter 12 can be gathered from FIGS. 4 to 9.

Figure 6:
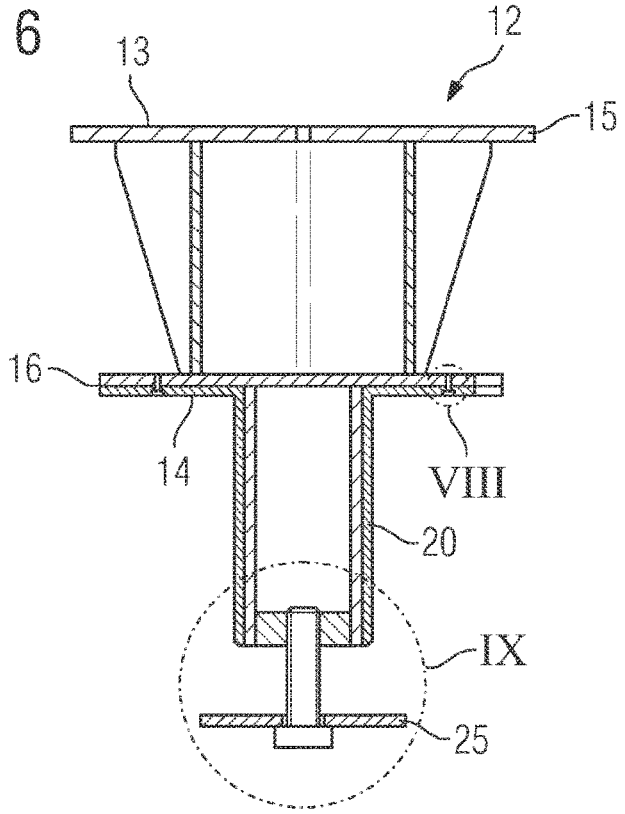
FIG. 6 is a section taken along line VI-VI in FIG. 5.
Figure 8:
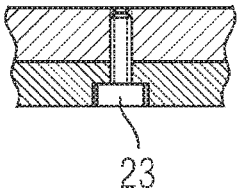
FIG. 8 is an enlarged illustration of the detail A from FIG. 6.

The adapter 12 has a crane-side attachment surface 13, which is to be directed toward the crane 5 when the adapter is mounted, and a casing-side attachment surface 14, which is to be directed toward the lower casing half 3 of the turbine 1 when the adapter is mounted. In specific terms, the adapter 12 comprises a crane-side base plate 15, which defines the crane-side attachment surface 13, and a casing-side base plate 16, which defines the casing-side attachment surface 14. The crane-side base plate 15 is distinguished by a square shape and the casing-side base plate 16 is distinguished by a round shape. In the case of the exemplary embodiment illustrated, the casing-side base plate 16 is formed by two sub-plates which are located one upon the other and, as can be gathered from FIGS. 6 and 8, are connected to one another by means of screws 23.

Two recesses 17 are provided in the round casing-side base plate 16, the recesses extending as far as the periphery of the base plate 16. The recess creates space for non-removable elements which can be, or are, present on the lower casing half 3, in the region of the joint 11. For example, the lower casing half can accommodate heads of mounted screws or the free ends of mounted threaded rods and/or nuts, which, for stability reasons, must not be removed.

The two base plates 15, 16 are connected to one another via a tubular connecting element 18, which has the casing-side base plate 16 fastened on its one end side and has the crane-side base plate 15 fastened on its other end side, and via four stabilizing crosspieces 19, which are oriented along the diagonals through the quadrilateral crane-side base plate 15. The tubular connecting element 18 is distinguished, as can be seen in FIG. 4, by a square cross section.

It is also the case that the two base plates 15, 16 extend at least essentially parallel to one another.

In order that the crane 5 can be fastened on the lower casing half 3 of the turbine 1 via the adapter 12, the adapter 12 has, on the one hand, means for fastening on the lower casing half 3, the means in the present case comprising a cylindrical fastening bolt 20, which projects from the casing-side base plate 16, and, on the other hand, means for fastening on the crane 5, the means in the present case comprising four threaded bores 21, which are provided in the crane-side base plate 15.

Figure 4:
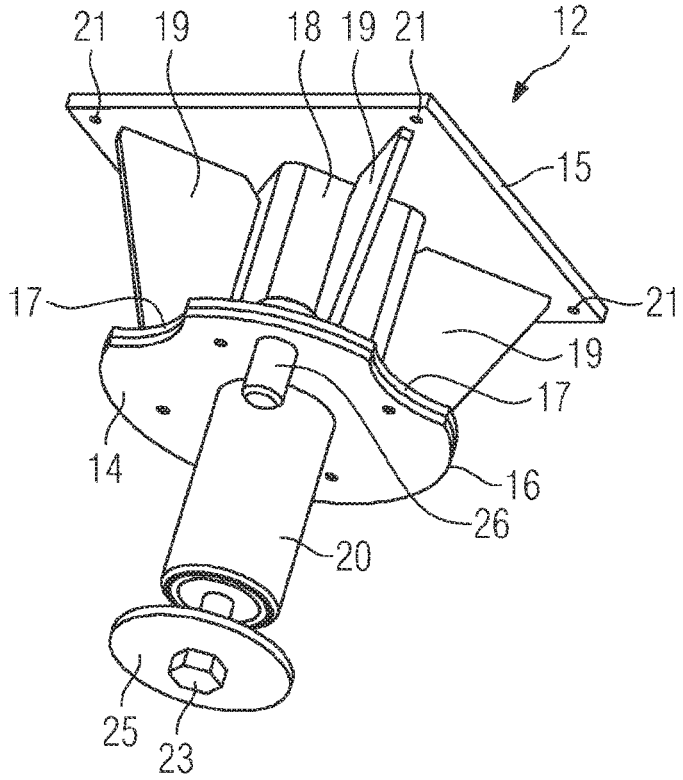
FIG. 4 is a view of the adapter from FIGS. 1 and 3 as seen obliquely from beneath.
Figure 5:
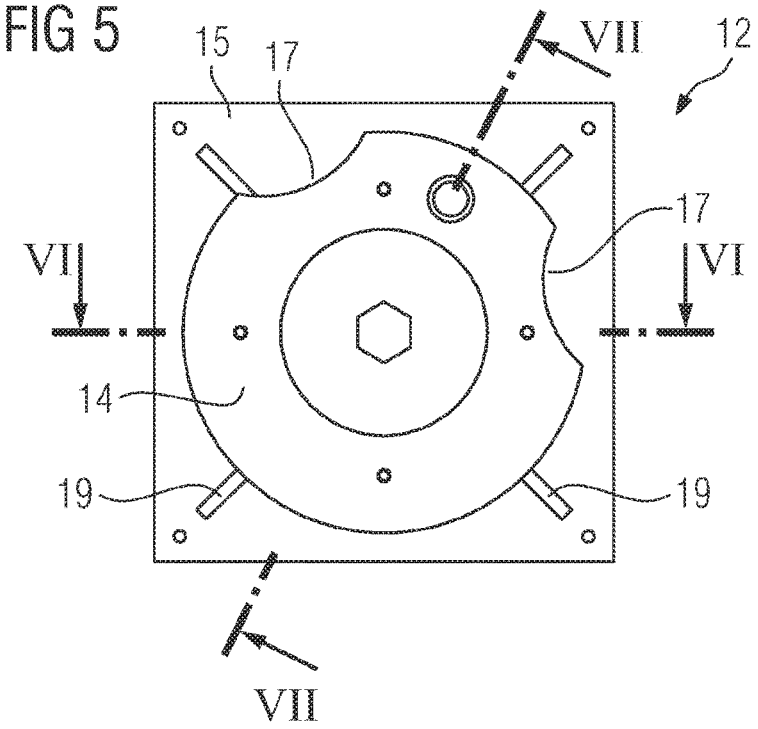
FIG. 5 is a view of the adapter from FIGS. 1 and 3 as seen from beneath.

The four threaded bores 21, as can likewise be gathered from FIG. 4, are arranged in the four corners of the crane-side base plate 15. Their hole pattern corresponds to that of four through-passage bores which are provided on the tower 6 of the crane 5, specifically in a foot plate 22 provided at the free end of the tower 6 of the crane 5 (cf. FIG. 2). The means of the adapter 12 for fastening on the crane 5 also comprise four screws 23, which each extend through a through-passage bore in the foot plate 22 and are screwed into a corresponding threaded bore 21 in the crane-side base plate 15. In this way, the adapter 12 is connected to the tower 6 of the crane 5 in a stable and releasable manner.

In the case of the exemplary embodiment illustrated, the adapter 12 is fastened on the lower casing half 3 via the cylindrical fastening bolt 20, which can be gathered in particular from FIG. 4 and projects from the casing-side base plate 16, specifically from that side of the latter which defines the casing-side attachment surface 14. The outer contour of the fastening bolt 20 is adapted to the inner contour of a through-passage bore, which is provided in the lower casing half 3, in the region of the joint 11, and through which extend, in the closed state of the turbine casing, the joint bolts provided for connecting the two casing halves.

In FIGS. 1 and 2, which show the adapter 12 in the mounted state, the cylindrical fastening bolt 20 has been fitted into the through-passage bore on the lower casing half 3 and, accordingly, cannot be seen.

Figure 9:
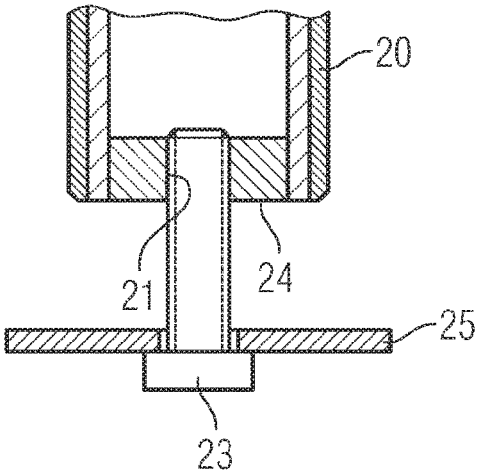
FIG. 9 is an enlarged illustration of the detail B from FIG. 6.

The means of the adapter 12 for fastening on the housing comprise, in addition to the cylindrical fastening bolt 20, a threaded bore 21, which is provided in the fastening bolt 20, specifically in the free end side 24 of the latter, the end side being oriented downward in FIGS. 4, 6, 7 and 9, and also comprise a screw 23 and a washer 25 (cf. FIG. 9). The longitudinal axis of the threaded bore 21 and the longitudinal axis of the fastening bolt 20 coincide.

Figure 7:
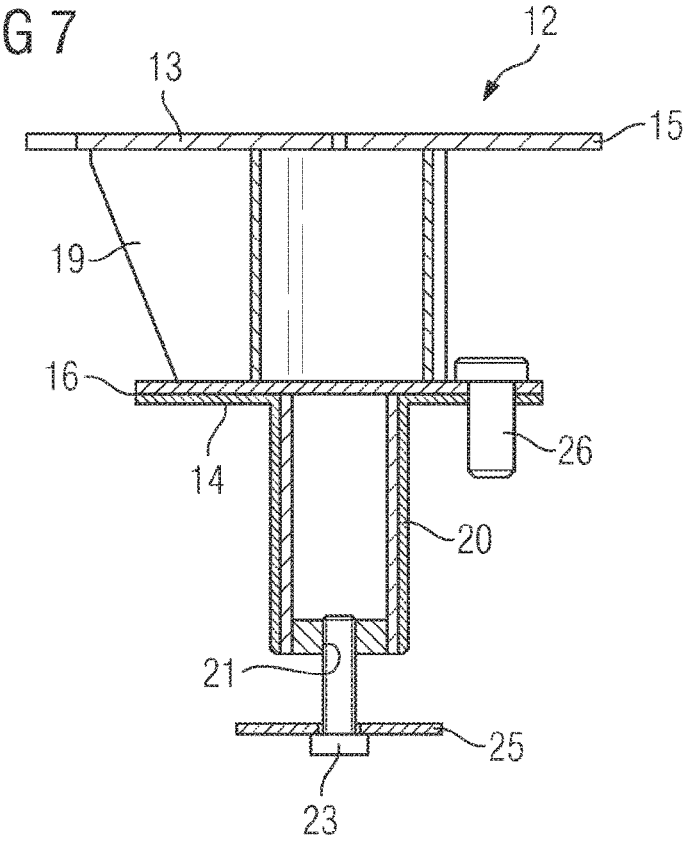
FIG. 7 is a section taken along line VII-VII in FIG. 5.

In order to prevent rotation in the mounted state, the adapter 12 also comprises a cylindrical securing element 26, which projects from the casing-side base plate 16 and, as can be gathered in particular in FIG. 4, has a smaller diameter, and a shorter length, than the cylindrical fastening bolt 20. The securing element 26 is designed, and arranged, such that, in the mounted state of the adapter 12, it engages in an aperture, in the present case a further through-passage bore, which is present in the lower casing half 3, in the region of the joint 11. The securing element 26 is designed here such that, in the mounted state, it is seated in the further through-passage bore in a form-fitting manner. In the case of the exemplary embodiment illustrated, the securing element 26, as can be seen in FIG. 7, has been fitted into an opening provided in the casing-side base plate 16 and, for axial fixing purposes, has a head region of relatively large diameter.

For the fastening of the adapter 12 on the lower casing half 3, the fastening bolt 20 has been fitted, from the upper side thereof, into the through-passage bore which is present in the region of the joint 11, and the screw 23, with the washer 25 located thereon, has been screwed, from the underside of the through-passage bore, into the threaded bore 21 in the fastening bolt 20.

Should the crane 5 be fastened on a turbine casing which is distinguished by through-passage bores of different dimensions and/or in different positions, that is to say by a different hole pattern in the region of the joint, it is easily possible to provide a different adapter, of which the fastening bolt and securing element are designed, and arranged, such that they fit the different hole pattern.

As mentioned above, the crane 5 fastened on the lower casing half 3, in the manner described above, via the adapter 12 is used for removing the blades 4.

In addition to the crane 5, as can be seen in FIG. 1, a working platform 27 has been fastened on the turbine casing, specifically the lower casing half 3, in the region of the joint 11, it being possible for a fitter to access the platform in order to carry out blade-removal work and in order to control the crane 5 via an operating unit, which is provided on the crane 5 but is not illustrated in the figures.

For removal of a blade 4, the latter is first of all moved, by appropriate positioning of the rotor of the turbine 1, into the 12 o'clock position. A blade 4 in this position can be gathered from FIG. 1. Then, the jib 7 of the crane 5 is moved, by a fitter standing on the working platform 27, into position such that the free end of the jib 7 is located at least approximately above the blade 4 which is to be removed, as is illustrated in FIG. 1. The blade 4 is gripped, and moved out of the installation position, by means of the gripper 10, which is fastened on the cable 9. This can take place solely by control on the part of the crane 5 or by manual intervention on the part of the fitter, wherein the fitter need never bear the entire weight of the blade 4, of approximately 45 kg; rather, at most, he causes the blade 4 to move, while the latter is borne by the crane 5. The blade 4 removed from its installation position can be moved by the crane 5 to the working platform 27, or also to some other set-down location alongside the turbine 1.

Once in particular all the blades 4 have been removed in this way, it is possible for further work, which can include both the removal and the installation of blades or other components of the turbine 1, to be carried out with the aid of the crane 5 and, if the crane 5 is no longer required, the latter can be removed again from the lower casing half 3 by the screw 23 screwed into the cylindrical fastening cylinder 21 being unscrewed and the crane 5 being raised, and thus the fastening bolt 20 being removed from the through-passage bore in the lower casing half 3.

Implementation of the method according to embodiments of the invention and the use according to embodiments of the invention of the crane 5 which is fastened temporarily on the lower casing half 3 provide for particularly safe handling of turbine components and therefore a particularly high level of work safety.

Although the invention has been illustrated and described in greater detail with reference to the preferred exemplary embodiment, the invention is not limited to the examples disclosed, and further variations can be inferred by a person skilled in the art, without departing from the scope of protection of the invention.

For the sake of clarity, it is to be understood that the use of "a" or "an" throughout this application does not exclude a plurality, and "comprising" does not exclude other steps or elements.

The invention claimed is:

1. A method for mounting and/or removing components of a turbine having a turbine casing, comprising:

fastening a crane on the turbine casing via an adapter having a crane-side base plate vertically separated from a casing-side base plate by a gap extending along a vertical axis of the adapter; and fitting at least one component which is to be mounted in an installation position with an aid of the crane and/or removing the at least one component which is to be removed from the installation position with the aid of the crane, wherein the at least one component which is to be mounted and/or removed is a turbine blade;

wherein the adapter connected to the crane, has a cylindrical fastening bolt, of which an outer contour is adapted to an inner contour of a through-passage bore in a lower casing half, in a region of a joint, and, for a purpose of fastening the crane, the cylindrical fastening bolt is inserted into the through-passage bore and fixed by means of at least one screw.

2. The method as claimed in claim 1, wherein the crane is fastened on the lower casing half in a region of the joint, which in an open state of the turbine casing, the joint divides the turbine casing in two.

3. The method as claimed in claim 1, wherein the crane is fastened on the turbine casing using the through-passage bore in the in the lower casing half.

4. The method as claimed in claim 1, wherein the crane has a tower and a jib, which is fastened on the tower in an articulated manner.

5. The method as claimed in claim 4, wherein the crane is fastened on the turbine casing such that the tower is oriented at least essentially vertically.

6. The method as claimed in claim 1, wherein the adapter includes a connecting element located between the crane-side base plate and the casing-side base plate to form the gap.

* * * * *